US009611017B2

(12) United States Patent
Jeng

(10) Patent No.: US 9,611,017 B2
(45) Date of Patent: Apr. 4, 2017

(54) MULTIPLE TORPEDO STORAGE AND LAUNCH SYSTEM

(71) Applicant: Ocom Technology LLC, Arcadia, CA (US)

(72) Inventor: Jack Ing Jeng, Arcadia, CA (US)

(73) Assignee: Ocom Technology LLC., Arcadia, CA (US)

( * ) Notice: Subject to any disclaimer, the term of this patent is extended or adjusted under 35 U.S.C. 154(b) by 0 days.

(21) Appl. No.: 14/955,503

(22) Filed: Dec. 1, 2015

(65) Prior Publication Data

US 2016/0257384 A1 Sep. 8, 2016

Related U.S. Application Data

(60) Provisional application No. 62/093,569, filed on Dec. 18, 2014.

(51) Int. Cl.
*B63G 5/00* (2006.01)
*F41F 3/10* (2006.01)

(52) U.S. Cl.
CPC . *B63G 5/00* (2013.01); *F41F 3/10* (2013.01)

(58) Field of Classification Search
CPC ..... F41F 3/08; F41F 3/10; F42B 19/00; F42B 19/01; F42B 19/04; F42B 19/06; F42B 19/12; F42B 19/36; F42B 19/46; B63B 2702/00; B63B 2702/10; B63B 2702/12
USPC ..... 114/18, 19, 20.1, 21.1, 21.2, 21.3, 25, 114/238, 239, 312, 313, 316, 320, 321, 114/337
See application file for complete search history.

(56) References Cited

U.S. PATENT DOCUMENTS 4,003,291 A * 1/1977 Vass ..... F41F 3/07 102/410
5,666,897 A * 9/1997 Armstrong ..... F41F 3/10 114/20.1
5,698,817 A * 12/1997 Hillenbrand ..... B63B 49/00 114/21.2
6,158,370 A * 12/2000 French ..... B63G 8/22 114/121
8,677,920 B1 * 3/2014 Jeng ..... B63B 3/08 114/312
2014/0209003 A1 * 7/2014 Kumano ..... F41F 3/10 114/20.1

* cited by examiner

*Primary Examiner* — Bret Hayes
(74) *Attorney, Agent, or Firm* — The Mueller Law Office, P.C.

(57) ABSTRACT

Disclosed herein is an aquatic vehicle torpedo launch system comprising of an aquatic vehicle. A torpedo launch system is coupled to the aquatic vehicle. The torpedo launch system is operable in a neutral buoyance position. A plurality of torpedoes is included. Each torpedo is coupled to the torpedo launch system with a locking means. Power cables are coupled to each torpedo providing power to the plurality of torpedoes. Fiber optic cables are coupled to each torpedo enabling programming of the plurality of torpedoes. The locking means, the power cables and the fiber optic cables are disengaged from the plurality of torpedoes prior to launch. Each torpedo is launched by buoyancy.

20 Claims, 14 Drawing Sheets

MULTIPLE TORPEDO STORAGE AND LAUNCH SYSTEM

CROSS REFERENCE TO RELATED APPLICATIONS

This patent application claims priority from U.S. Provisional Patent Application No. 62/093,569 filed on Dec. 18, 2014. The disclosure of the entire prior listed patent application is considered part of the disclosure of this application and is incorporated by reference.

BACKGROUND

Traditionally torpedoes, such as MK-48 and MK-46 designs, are designed to destroy adversary aquatic vessels which may be surface vessels or submarine vessels. Typically, torpedoes do not have programming capabilities and most torpedoes do not utilize electric batteries because battery power diminishes over time. Torpedoes typically use a gas engine and compressed air to provide the power after the torpedo is loaded and launched by a submarine crew. These torpedoes are mainly launched from a launching tube with a complicated compressed air manifold system. The procedure to load and launch a torpedo is time consuming, requires careful operation by the crew, and is dangerous. The storage and launch system for a torpedo requires a large amount of precious high pressure waterproof space of a manned submarine, and the refill of multiple torpedoes takes a long time.

There are typically six steps to launch a torpedo. In step 1, with an outer door closed, an inner door is opened and a torpedo is loaded into a launch tube. The launch tube may be high pressure waterproof with complicated manifold water and pneumatic pipes. The inner door is then closed. In step 2, water pressure prevents the outer door from opening. To offset this pressure, the launch tube may be flooded from a shipboard tank, then a valve to the sea may open to equalize the pressure. The displaced air is vented inboard. In step 3, the outer door may be opened and the torpedo is ready to fire. In step 4, compressed air ejects the torpedo. The air is vented inboard so that air pockets or bubbles cannot rise to the surface and reveal the position of the vessel. In step 5, the compressed air may be shut off and the launch tube fills with seawater. This offsets the lost weight of the torpedo and keeps the vessel in trim. In step 6, the outer door is closed and the launch tube drains to a drain tank. The inner door may now be opened and the launch tube reloaded.

Traditionally, when a torpedo is launched, exhaust and pneumatic noise may be generated due to the gas engine. An adversary ship may detect these noises and launch counter measure devices to confuse the torpedo.

A typical unmanned underwater vehicle does not have the capabilities to store a large number of torpedoes and does not have a torpedo launch system. A modern manned submarine such as a German Type-214 design or a Japan Soryu design is approximately 4,000 tons, stores 24 to 30 torpedoes, requires about 65 crew members and officers and costs approximately $400 million. In contrast, a J-type Underwater Vehicle (JUV) such as a JUV-700, is approximately 100 tons, stores 40 torpedoes, requires six crew members or unmanned operation and costs approximately $30 million.

SUMMARY

Disclosed herein is an aquatic vehicle torpedo launch system comprising of an aquatic vehicle. A torpedo launch system is coupled to the aquatic vehicle. The torpedo launch system is operable in a neutral buoyance position. A plurality of torpedoes is included. Each torpedo is coupled to the torpedo launch system with a locking means. Power cables are coupled to each torpedo providing power to the plurality of torpedoes. Fiber optic cables are coupled to each torpedo enabling programming of the plurality of torpedoes. The locking means, the power cables and the fiber optic cables are disengaged from the plurality of torpedoes prior to launch. Each torpedo is launched by buoyancy.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

Figure 1:
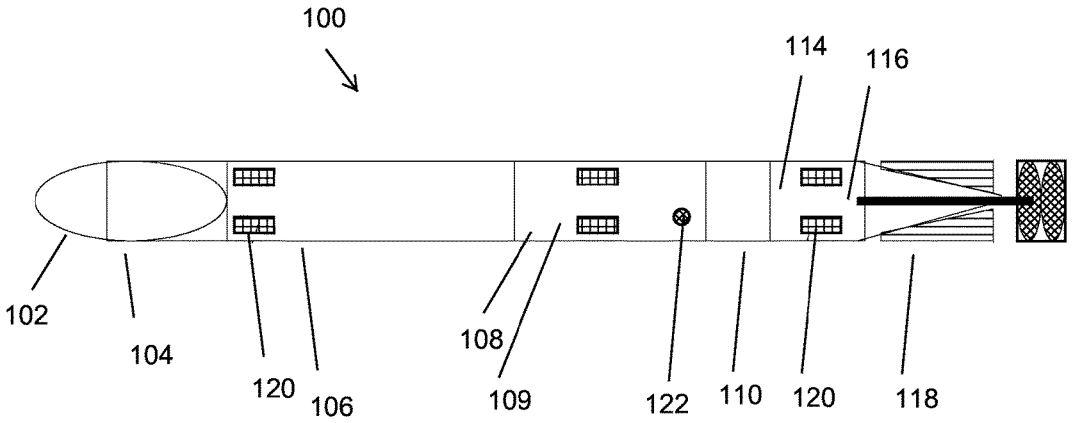
FIG. 1 is an example embodiment of a J-type smart mini torpedo.

Disclosed herein is an aquatic vehicle torpedo launch system comprising of an aquatic vehicle. A torpedo launch system is coupled to the aquatic vehicle. The torpedo launch system is operable in a neutral buoyance position. A plurality of torpedoes is included. Each torpedo is coupled to the torpedo launch system with a locking means. Power cables are coupled to each torpedo providing power to the plurality of torpedoes. Fiber optic cables are coupled to each torpedo enabling programming of the plurality of torpedoes. The locking means, the power cables and the fiber optic cables are disengaged from the plurality of torpedoes prior to launch. Each torpedo is launched by buoyancy.

In one embodiment, the torpedo launch system comprises of a stationary support frame, a barrel assembly and a rotation means. The barrel assembly includes a circular array of substantially parallel barrels with an axial shaft. The circular array of barrels are mounted to rotate within the stationary support frame on the axial shaft. The rotation means for rotating the barrel assembly operates such that each barrel is rotated past a stationary firing position once during each revolution of the barrel assembly. The stationary firing position is located in the support frame adjacent the barrel assembly. A door on the aquatic vehicle may be located above the stationary firing position and may have a closed first position and an open second position. When the door is in the open second position, the locking means, the power cables and the fiber optic cables are disengaged from the plurality of torpedoes.

In another embodiment, the torpedo launch system comprises a flat platform and a stationary support frame coupled to the platform. In this configuration, the torpedo launch system with the plurality of torpedoes may be capable of being dropped from the air for delivery, towed by a vessel and transported in a freight container.

In one embodiment, the aquatic vehicle may be configured to operate unmanned. The aquatic vehicle may be capable of storing up to 40 torpedoes at one time.

The plurality of torpedoes may be capable of being programmed with a navigational plan prior to launch. More than one of the plurality of torpedoes may be launched at the same time.

In another embodiment, the power cables may be copper cables. Moreover, the torpedo launch system may be capable of being reloaded with the plurality of torpedoes in the open sea.

Disclosed herein is a method for an aquatic vehicle torpedo launch system comprising configuring an aquatic vehicle and coupling a torpedo launch system to the aquatic vehicle. The torpedo launch system is operable in a neutral buoyance position. A plurality of torpedoes are coupled to the torpedo launch system with a locking means. Power cables are coupled to each torpedo, providing power to the plurality of torpedoes. Fiber optic cables are coupled to each torpedo enabling programming of the plurality of torpedoes. The locking means, the power cables and the fiber optic cables are configured to be disengageable from the torpedo. Each torpedo is capable of launching by buoyancy.

In one embodiment, a door may be located above the stationary firing position having a closed first position and an open second position. The door may be unfastened to the open second position. When the door is in the open second position, the locking means, the power cables and the fiber optic cables are disengaged from the plurality of torpedoes.

The present embodiments provide an aquatic vehicle torpedo launch system comprising of an aquatic vehicle configured to operate manned or unmanned, with a torpedo launch system coupled to the aquatic vehicle. This may be a storage and launch system for a large number of torpedoes using an unmanned underwater vehicle and/or a manned underwater vehicle such as a submarine. FIG. 1 is an example embodiment of a torpedo, a J-type smart mini torpedo, for example, the JUV-9 torpedo 100. The JUV-9 torpedo 100 may have an inner diameter of, for example, 9.25 inches and may be 10 feet long. The JUV-9 torpedo 100 design may be configured of several modules forming a hull which house various functions such as a bow module 102, bow buoyance module 104, payload module 106, battery and central control module 108, stern buoyance module 110, motor control module 114, motor module 116 and stern/rudder module 118. In other embodiments, the order of the modules and size of the modules may be customizable depending on the application.

The JUV-9 torpedo 100 may also include multiple hook-lock receptacles 120 for securement during transportation, storing or staging for launch. A copper/fiber optic connector 122 may also be included so that a copper cable or power cable may be connected to supply power such as +48 V DC onboard the vessel and to recharge the electric power and battery of the JUV-9 torpedo 100. Moreover, a fiber optic cable may provide Giga-bit-Ethernet (GbE) capabilities to enable programming function to the JUV-9 torpedo 100.

Figure 2:
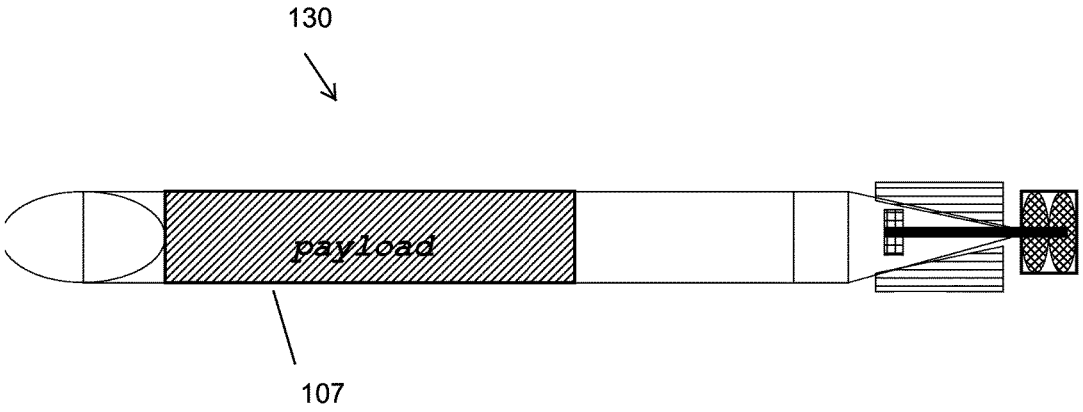
FIG. 2 shows an example embodiment of a unmanned underwater vehicle.

FIG. 2 shows an example embodiment of a large displacement unmanned underwater vehicle (LDUUV). This may be a J-type underwater vehicle such as a JUV-38 130 and may be equipped with torpedoes such as the JUV-9 torpedo 100 which may be mini smart torpedoes. The JUV-38 130 may have an inner diameter of, for example, 38 inches and may be 40 feet long consisting of several modules forming a hull which house various functions, similar to the JUV-9 torpedo 100 shown in FIG. 1. The modules may include the bow module, bow buoyance module, payload module 107, battery and central control module 109, stern buoyance module, motor control module, motor module and stern/rudder module. The order of the modules and size of the modules may be customizable depending on the application. For example, the payload module 107 may be used to store and launch the torpedoes and therefore, the size may vary to accommodate the amount of torpedoes onboard the vehicle. In different embodiments of a vessel with a 38 inch diameter circular hull and using a torpedo that is 10 inches in diameter and 12 feet long, the length of the payload module 107 may be 15 feet long to accommodate storing 8 torpedoes or 30 feet long to accommodate storing 16 torpedoes or 45 feet long to accommodate storing 24 torpedoes.

Figure 6:
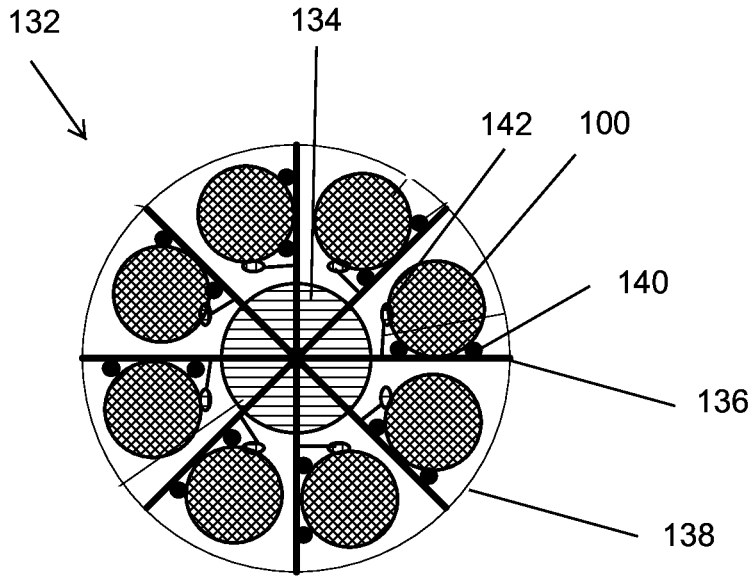
FIG. 6 is a front view of an example embodiment of the Gatling torpedo launcher.

An aquatic vehicle torpedo launch system may comprise an aquatic vehicle configured to operate unmanned such as the large displacement unmanned underwater vehicle (LDUUV), the JUV-38 130. A torpedo launch system may be coupled to the aquatic vehicle. For example, the payload module 107 of the JUV-38 130 may contain a "Gatling" torpedo launcher 132 (FIG. 6).

Figure 3:
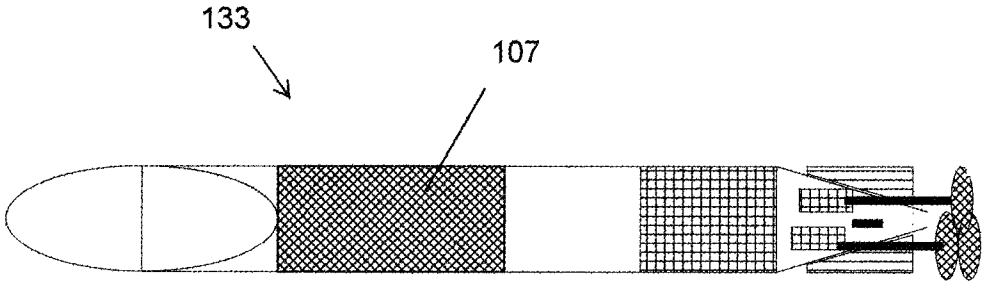
FIG. 3 depicts an example embodiment of an attacking unmanned underwater vehicle.
Figure 4:
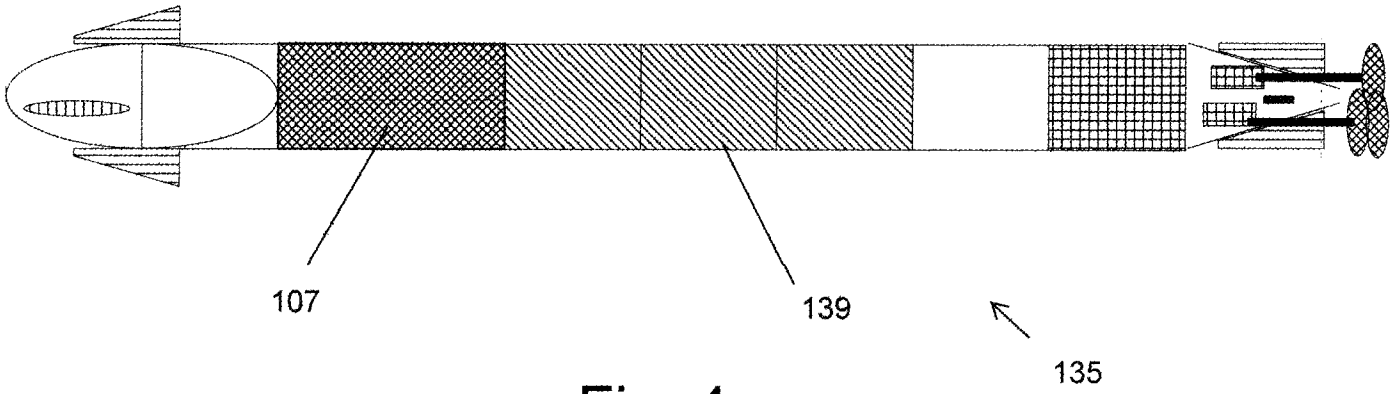
FIG. 4 shows an example embodiment of a manned underwater vehicle.
Figure 5:
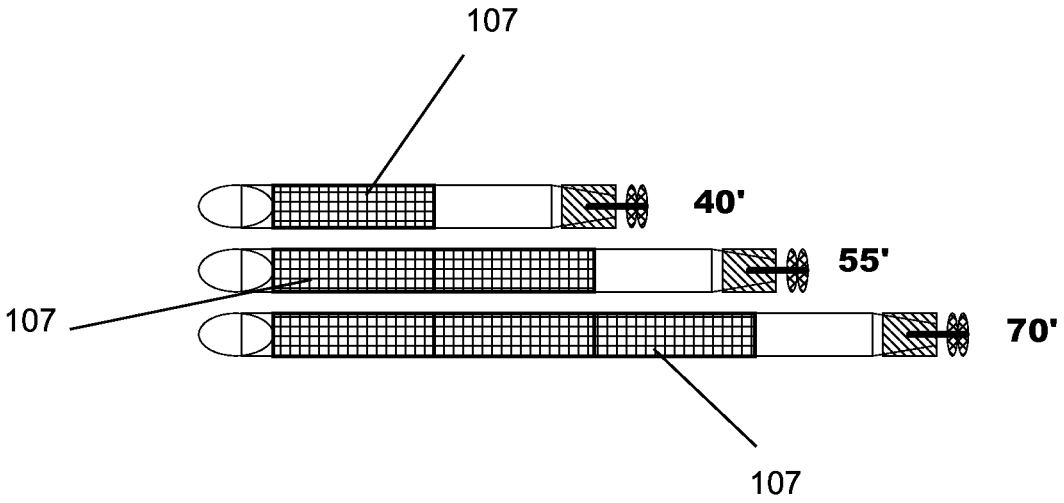
FIG. 5 shows example embodiments of different lengths of aquatic vehicles depending on the amount of payload modules.

In other embodiments, the aquatic vehicle may be an attacking unmanned underwater vehicle or a manned underwater vehicle. FIG. 3 depicts an example embodiment of an attacking unmanned underwater vehicle, a JUV-700A 133, which may have an inner diameter of 7 feet, may be 69 feet long and may weigh 75 tons. The payload module 107 may be 15 feet in length and capable of carrying or storing up to 40 JUV-9 torpedoes 100. FIG. 4 shows an example embodiment of a manned underwater vehicle, a JUV-700B 135, which may have an inner diameter of 7 feet, may be 87 feet in length and have a 27 feet long crew cabin module 139 for a six member crew. The payload module 107 may also be 15 feet in length and capable of carrying or storing up to 40 JUV-9 torpedoes 100. FIG. 5 shows example embodiments of different lengths of aquatic vehicles depending on the amount of payload modules 107 the vessel is equipped with. For example, for a vessel with a 38 inch diameter circular hull and using a torpedo that is 10 inches in diameter and 12 feet long, one payload module 107 may be capable of carrying 8 JUV-9 torpedoes 100 whereas two payload modules 107 may be capable of carrying 16 JUV-9 torpedoes 100 and three payload modules 107 may be capable of carrying 24 JUV-9 torpedoes 100.

The torpedo launch system may be operable in a neutral buoyance position. This may be achieved by designing each component in the system at approximately the same weight/volume ratio (density) equal to the seawater density. The torpedo launch system may be exposed to the seawater both inside of and outside of the payload module 107. The walls of the payload module 107 is for streamlined design, not for to keep seawater out. The density of the surface seawater typically ranges from approximately 1020 kg/m$^3$ to 1029 kg/m$^3$. Therefore, the torpedo may be designed with a density slightly less than the seawater density, for example, 1000 kg/m$^3$, so that the torpedo floats upward when disengaged from the torpedo launch system. FIG. 6 is a front view of an example embodiment of the Gatling torpedo launcher 132. The design of the Gatling torpedo launcher 132 has a similar physical arrangement as a Gatling gun using a cyclic multi-barrel design for launching torpedoes. The Gatling torpedo launcher 132 consists of a stationary support frame 136 and a barrel assembly 138 including a circular array of substantially parallel barrels with an axial shaft or roller 134. The circular array of barrels are mounted to rotate within the stationary support frame 136 on the axial shaft or roller 134. A rotation means for rotating the barrel assembly 138 is engaged such that each barrel is rotated past a stationary firing position once during each revolution of the barrel assembly 138. The rotation means may be, for example, a motor. The stationary firing position is located in the stationary support frame 136 adjacent to the barrel assembly 138.

The Gatling torpedo launcher 132 may be loaded with a plurality of JUV-9 torpedoes 100 allowing one JUV-9 torpedo 100 per each barrel of the barrel assembly 138. The plurality of torpedoes may be smart mini torpedoes, such as JUV-9 torpedoes 100. The roller 134, located in the center, may be motor controlled and has the stationary support frame 136 around the roller 134. The roller 134 is a shaft which rotates slowly and may be connected to a rotation means such as a step motor. The step motor may be an electric motor that divides a full rotation into a number of equal steps and the position may be commanded to move and hold at one of these steps. The step motor enables the roller 134 to rotate to a precise desired angle so a specific JUV-9 torpedo 100 in the Gatling torpedo launcher 132 may be launched when at the stationary firing position. A gearbox may be located between the step motor and roller 134. In one embodiment, the step motor may be programmed to an exact number of turns and a specific angle so as to drive a large, heavy roller 134 to an exact angle. Each torpedo may be coupled to each barrel of the circular array of barrels or the stationary support frame 136 with a locking means such as multiple hook-locks 140. The hook-locks 140 may be a mating pair of male-female connectors such as by fasteners, snap fit, press fit or twist and turn. Other locking means may be used such as magnets or buckles.

Figure 7:
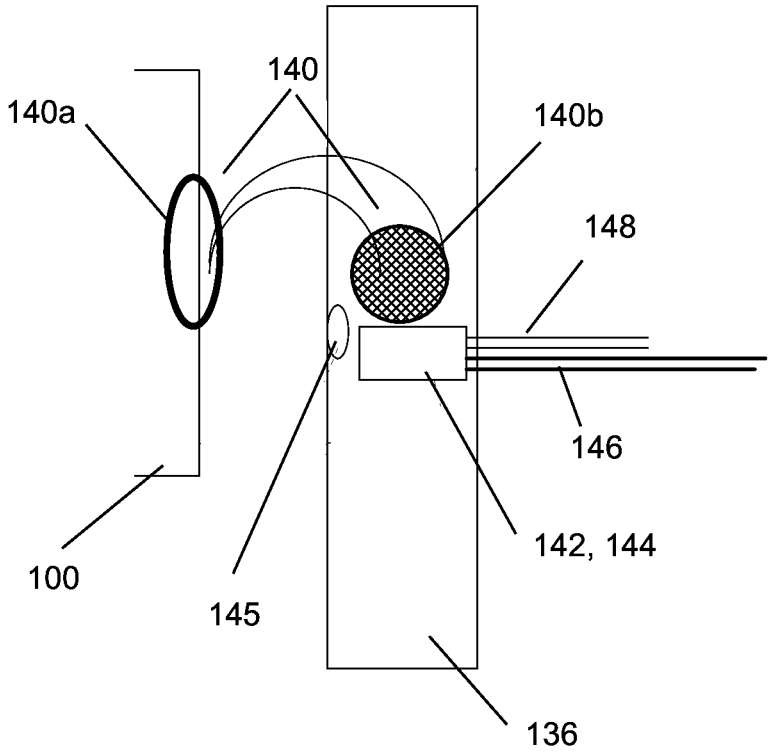
FIG. 7 illustrates a side view of an example embodiment of the stationary support frame of the Gatling torpedo launcher with a hook-lock design.

FIG. 7 illustrates a side view of an example embodiment of the stationary support frame 136 of the Gatling torpedo launcher 132 with a hook-lock 140 design. The male hook 140*b* on the stationary support frame 136 inserts into the female receptacle 140*a* on the JUV-9 torpedo 100 for securement while the roller 134 is moving or while the vessel is moving or for staging during launch. The female receptacle 140*a* may be of any shape, for instance, circular, rectangular or elongated. In one embodiment, the connection of the male hook 140*b* to the female receptacle 140*a* becomes tighter as it rotates. In one embodiment, there may be six hook-locks 140 fastening the JUV-9 torpedo 100 to the stationary support frame 136. The male hook 140*b* is coupled to the inside surface of the stationary support frame 136 so when the male hook 140*b* is installed in the female receptacle 140*a* in the locked position, there is no obstacle in the way of the torpedo being launched.

To perform the fastening and unfastening of the hook-lock 140, a first motor 142 in a first connector 144 may be used. The power consumption of the first motor 142 determines how tight the connection is between the lock and the hook receptacle. An ultrasonic transducer, laser or sensor 145 may be used to determine the exact distance between the female receptacle 140*a* and the male hook 140*b*. This aids in the fastening at the exact required angle and may be used to monitor the connection integrity. The power for the first motor 142 may be a +48 V DC cable 146 from the battery and central control module 109 onboard the vessel. The +48 V DC cable 146 power cable may be a copper cable. A GbE fiber optic cable 148 from the battery and central control module 109 onboard the vessel may be included for autonomous operation for the hook-lock 140.

Figure 8:
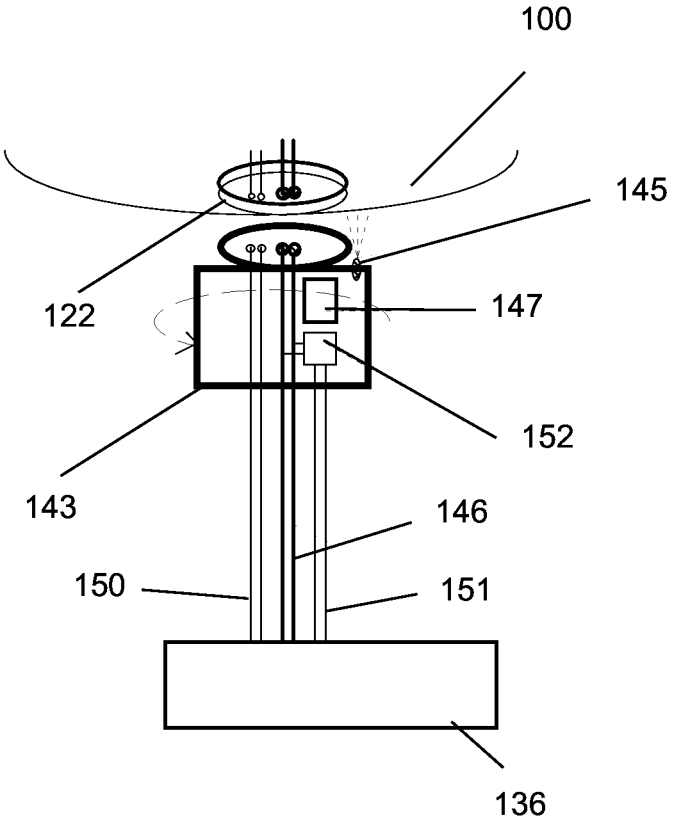
FIG. 8 depicts an example embodiment of the torpedo connected to the stationary support frame of the torpedo launcher.

FIG. 8 depicts an example embodiment of the torpedo, the JUV-9 torpedo 100, connected to the stationary support frame 136 of the torpedo launcher 132. The power cable such as the +48 V DC cable 146 may also be coupled to each JUV-9 torpedo 100 providing power to the plurality of JUV-9 torpedoes 100 and to recharge the electric power and battery of the JUV-9 torpedo 100. Additionally, fiber optic cables such as copper/fiber optic cables 150 and 151 may be used. These copper/fiber optic cables 150 and 151 may originate from the battery and central control module 109 onboard the vessel and through the stationary support frame 136. In one embodiment, copper/fiber optic cable 150 is routed from the stationary support frame 136 to the JUV-9 torpedo 100 and copper/fiber optic cable 151 may be routed from the stationary support frame 136 to an electronic control unit 152 in a second connector 143. The second connector 143 includes a second motor 147, and the electronic control unit 152 controls the operation of the fastening and unfastening of the cables.

The copper/fiber optic cable 150 coupled to each JUV-9 torpedo 100 enables programming of the plurality of JUV-9 torpedoes 100. In this way, the JUV-9 torpedo 100, such as a smart mini torpedo (SMT), may be quickly programmed with a navigational plan prior to launch eliminating the need for manned operation. In one embodiment, the JUV-9 torpedoes 100 may be programmed with a desired travel plan and target signature from a control center via a communication link before launch. The communication link may be 4G/5G mobile telecommunications, satellite communications or fiber optic communication, and the control center may be land based or underwater based, such as from another submarine or vessel. In another embodiment, the JUV-9 torpedoes 100 may be programmed from an onboard manned control center, for example, located in the battery and central control module 109 onboard the vessel. In another embodiment, the JUV-9 torpedoes 100 may be programmed via underwater sonar modem communication. In a further embodiment, the JUV-9 torpedoes 100 may be programmed before being loaded in the Gatling torpedo launcher 132.

The second motor 147 controls the connections of the +48 V DC cable 146 and the copper/fiber optic cables 150 and 151. In this way, the second motor 147 may tighten or loosen the waterproof connections for these cables to the JUV-9 torpedo 100. In one embodiment, the connections may be similar to a ring washer on an aquatic hose. The copper/fiber optic cable 151 routed from the stationary support frame 136 to the electronic control unit 152 in the second connector 143 may provide autonomous operation for the connections. The second connector 143 may be designed to be minimal in size so as to not block or interfere with a JUV-9 torpedo 100 when launching.

To load the JUV-9 100 torpedo on the storage and launch system, a copper/fiber optic cable is connected from the rotary supporting frame to the torpedo by a GbE fiber optic link from the control center to the copper/fiber connector electronic control unit. This fastens the connector in a locked and waterproof position. The copper cable may supply +48 V DC to sustain and recharge the JUV-9 100 electric power and battery. The fiber optic cable may provide Giga-bit-Ethernet (GbE) to enable programming function to the JUV-9. The fiber optic and copper composite cable may connect the rotary supporting frame to one or more small mini torpedoes (SMTs) so as to enable the sustaining electric power and control/programming capabilities to the SMTs.

Figure 9:
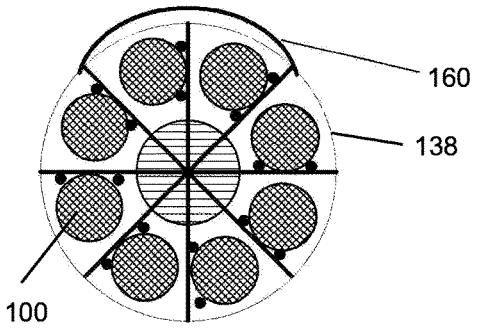
FIG. 9 shows an example embodiment of the torpedo launch process for the Gatling torpedo launcher.
Figure 10:
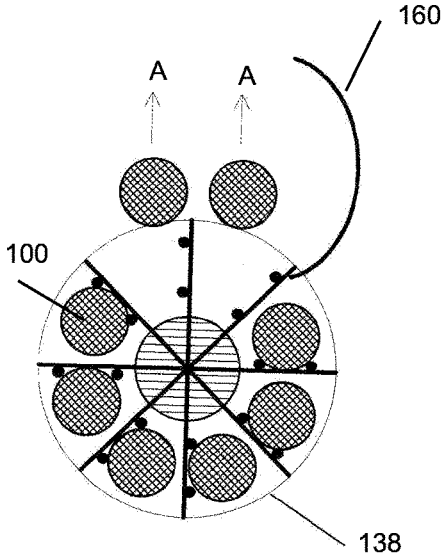
FIG. 10 is an example embodiment of the torpedo launch process for the Gatling torpedo launcher.

The Gatling torpedo launcher 132 may be housed in the payload module 107 of the vessel. FIGS. 9 and 10 show an example embodiment of the torpedo, the JUV-9 torpedo 100, launch process for the Gatling torpedo launcher 132. A door 160 is located above the stationary firing position of the Gatling torpedo launcher 132 on the payload module 107. FIG. 9 illustrates an example embodiment of the door 160 in a closed first position while FIG. 10 shows an example embodiment of the door 160 in an open second position. When the door 160 is in the open second position, the locking means such as the hook-locks 140, the power cables such as the +48 V DC cable 146 and the fiber optic cables such as the copper/fiber optic cables 150 are disengaged from the JUV-9 torpedoes 100. The JUV-9 torpedo 100 is launched by buoyancy when the JUV-9 torpedo 100 is at the stationary firing position.

Launching due to buoyancy may be achieved by designing the density of each component in the system to approximately the same density of the seawater while designing the density of the torpedo to slightly less than the density of the seawater. In this manner, when the torpedo is released, the torpedo floats upward because its density is less than the density of the seawater. By the buoyance function of the JUV-9 torpedo 100, such as a SMT, the JUV-9 torpedo 100 floats upward toward the sea level surface with the bow in the up position as depicted with an arrow and in the direction of A in FIG. 10. In this way, there is no complicated, cumbersome, large or time consuming high pressure air system required to launch the JUV-9 torpedo 100. The Gatling torpedo launcher 132 does not require a high pressure waterproof hull or modules because the inside and the outside of the Gatling torpedo launcher 132 is always exposed to the seawater with the attached underwater vehicle. The JUV-9 torpedo 100 executes a navigation plan after the launch by sailing according to the programmed travel plan. This may be launched from an unmanned underwater vehicle (UUV) or a manned underwater vehicle (MUV).

In one embodiment, as the torpedo or the JUV-9 torpedo 100 makes its final approach to the target, the torpedo may emerge to the surface to have final confirmation from a control center via the 4G/5G mobile telecommunication or satellite communication link. A periscope on the JUV-9 100 may have a camera to transmit target pictures or videos to the control center for verification.

After launching the first JUV-9 torpedo 100, the roller 134 of the Gatling torpedo launcher 132 is moved to the next position to launch the next JUV-9 torpedo 100. Since the payload module 107 is designed in a neutral buoyance position, it does not require a high pressure hull to protect the JUV-9 torpedo 100 or stationary support frame 136. In other words, the Gatling torpedo launcher 132 is always exposed to high pressure water. This uncomplicated design reduces the cost of construction and manufacturing by a large amount.

Figure 11:
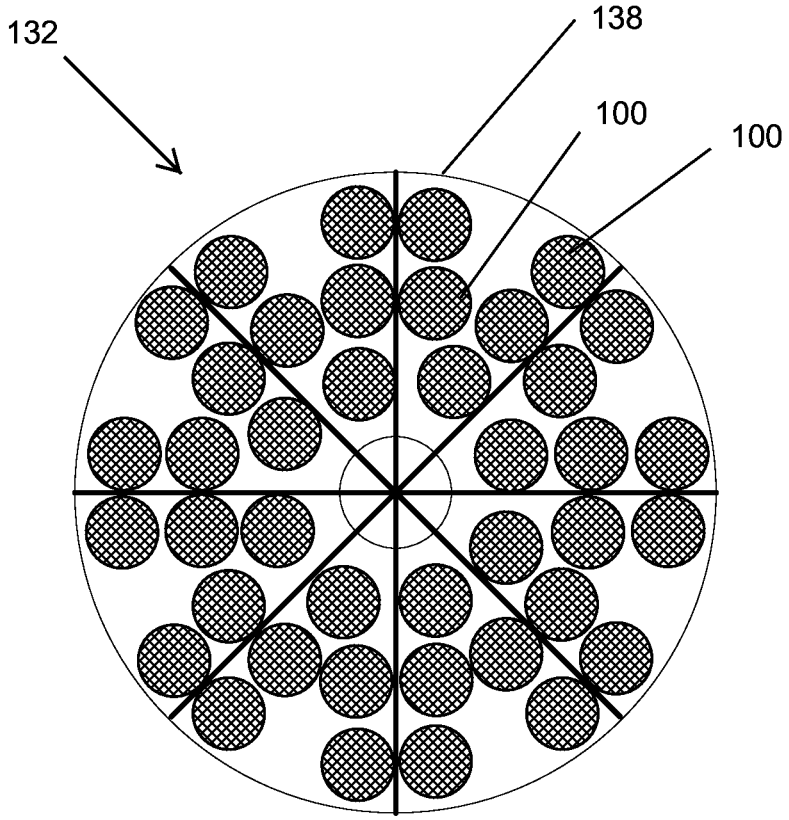
FIG. 11 illustrates an example embodiment of the Gatling torpedo launcher.

In another embodiment, the Gatling torpedo launcher 132 may be loaded with a plurality of JUV-9 torpedoes 100 allowing more than one JUV-9 torpedo 100 per each barrel of the barrel assembly 138. In further embodiments, each barrel of the barrel assembly 138 may hold and secure up to −40 JUV-9 torpedoes 100 at one time. In this scenario, the diameter of the hull or module is 7 feet. For example, FIG. 11 illustrates an example embodiment of the Gatling torpedo launcher 132. This embodiment is similar to FIG. 6 as described above; however, for example, each barrel of the barrel assembly 138 may hold and secure five JUV-9 torpedoes at one time. As the rotation means for rotating the barrel assembly 138 is engaged, each barrel is rotated past a stationary firing position once during each revolution of the barrel assembly 138. The stationary firing position is located in the stationary support frame 136 adjacent to the barrel assembly 138. When the door 160 is in the open second position, one JUV-9 torpedo 100 may be launched. In another embodiment, two JUV-9 torpedoes 100 from different barrels are launched at the same time. In a further embodiment, two JUV-9 torpedoes 100 from the same barrel are launched at the same time. In other embodiments, more than one JUV-9 torpedoes 100 are launched at the same time. The JUV-9 torpedoes 100 may be from the same barrel or from a different barrel. When a JUV-9 torpedo 100 is launched, the hook-locks 140 may be hidden inside the stationary support frame 136 so as not to interfere with other layers of JUV-9 torpedoes 100 waiting to be launched.

Figure 12:
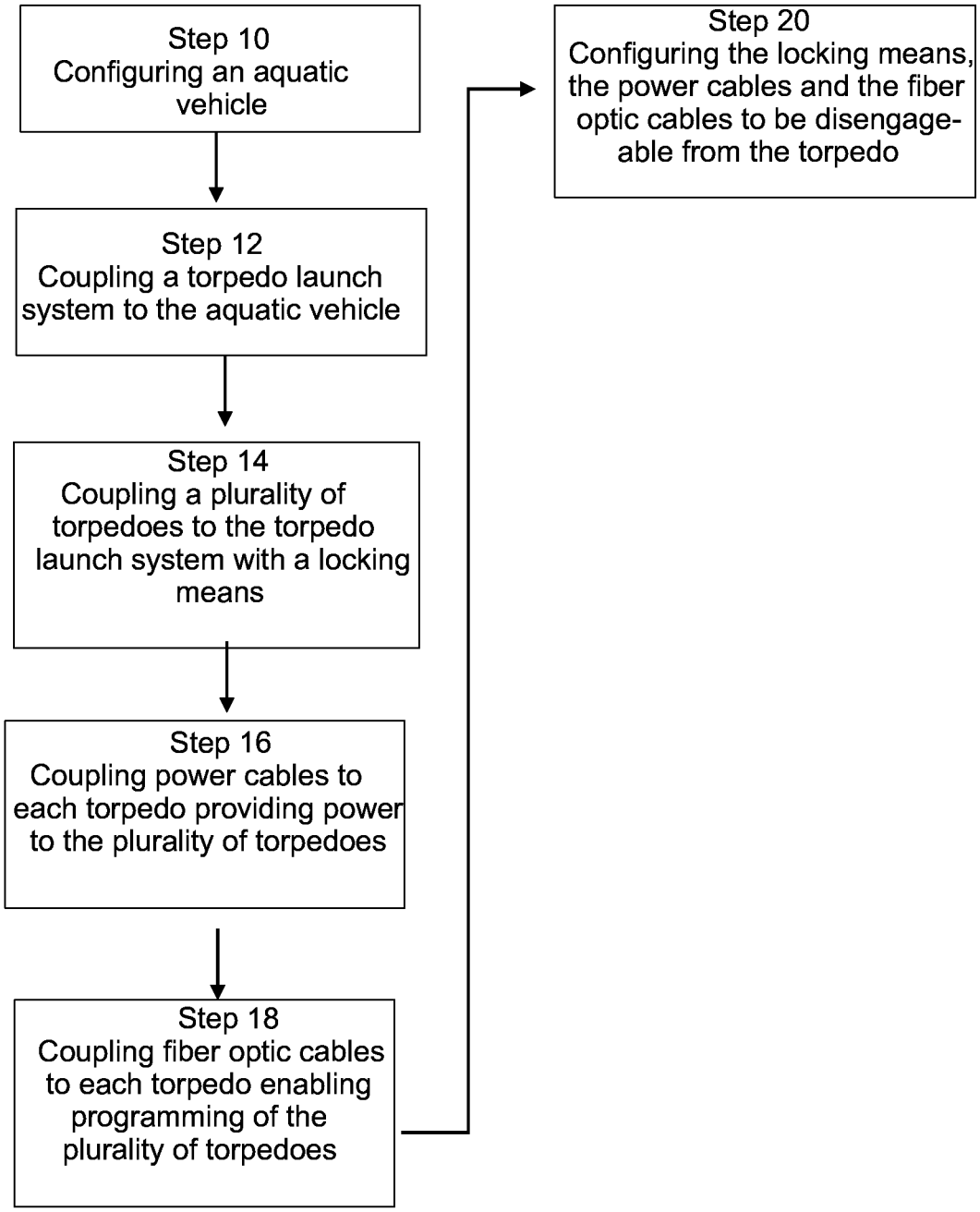
FIG. 12 illustrates an example embodiment of a flowchart for a method for configuring an aquatic vehicle torpedo launch system.

FIG. 12 illustrates an example embodiment of a flowchart for a method for configuring an aquatic vehicle torpedo launch system. Step 10 configures an aquatic vehicle to operate unmanned. Step 12 couples a torpedo launch system 132 to the aquatic vehicle. The torpedo launch system 132 is operable in a neutral buoyance. In step 14, a plurality of torpedoes, such as the JUV-9 torpedoes 100, are coupled to the torpedo launch system with a locking means such as the hook-locks 140. In step 16, power cables, such as +48 V DC cable 146 are coupled to each torpedo providing power to the plurality of torpedoes. In step 18, fiber optic cables, such as copper/fiber optic cables, are coupled to each torpedo enabling programming of the plurality of torpedoes. In step 20, the locking means, the power cables and the fiber optic cables are configured to be disengageable from the torpedo. Each torpedo is capable of launching by buoyancy and the plurality of torpedoes execute a navigation plan after the launch.

In another embodiment, the torpedo launch system may comprise a platform being flat and a stationary support frame coupled to the platform. The plurality of torpedoes may be coupled to the platform in a flat arrangement. For instance, six torpedoes, such as JUV-9 torpedoes 100, may be coupled flat on the platform forming a platform torpedo launcher 170 (FIG. 6). In one instance, the platform may be 7 feet by 15 feet so as to fit inside of a typical freight container. This configuration may be a makeshift unmanned submarine having all the functions of an attacking submarine such as buoyancy control, snorkeling functions, satellite communication, fiber optic communication and sonar navigation.

Figure 13A:
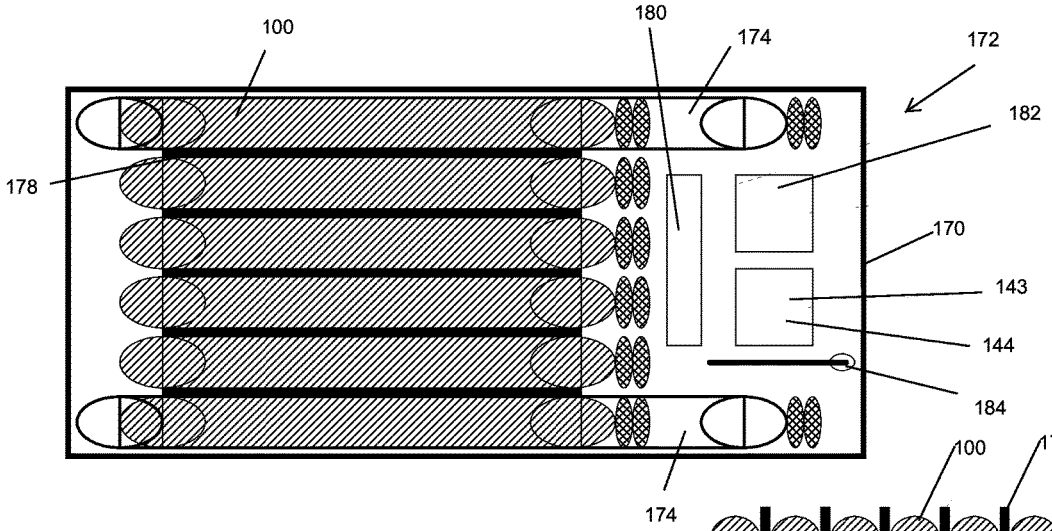
FIG. 13A and FIG. 13B depict a top view and a front view, respectively, of an example embodiment of a catamaran torpedo storage and launch system.
Figure 13B:
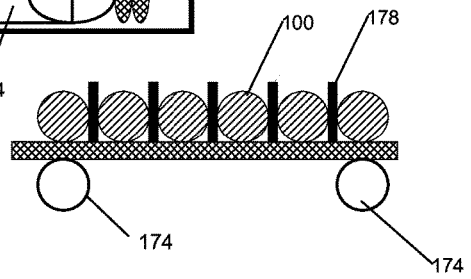

FIGS. 13A and 13B depict a top view and a front view, respectively, of an example embodiment of a catamaran torpedo storage and launch system 172. In one embodiment, the catamaran torpedo storage and launch system 172 may consist of the platform torpedo launcher 170 and a catamaran J-type underwater vehicle (JUV) configuration using two JUVs 174 on each side. This configuration allows for minimum movement to conserve electric power while providing the buoyancy for 4G/5G mobile communication or satellite communication and snorkeling function. The platform torpedo launcher 170 may also be employed on a larger catamaran underwater vehicle. On a larger catamaran underwater vehicle, the larger hull has the ability to store more fuel which may enable long range capabilities while being a low cost attacking unmanned underwater vehicle.

On the platform torpedo launcher 170, there may be a sonobuoy 180 which is typically a relatively small buoy expendable sonar system that is dropped/ejected from aircraft or ships conducting anti-submarine warfare or underwater acoustic research. It may detect an adversary underwater vehicle (UV) and implement radio communications. The catamaran torpedo storage and launch system 172 may be commanded by a control center via the radio communication through the sonobuoy 180. The control center may be land based or underwater based, such as from another submarine or vessel. A gas engine and battery pack 182 provides the electric power for the entire system including the sonobuoy 180. The platform torpedo launcher 170 may have a periscope 184 to perform periscope functions, satellite communications and snorkeling functions. A typical sonobuoy may have an eight hour battery life to sustain operations in the open sea but by using the gas engine and battery pack 182, it may stay in operation for months to years by surfacing once every few days for recharging the battery pack 182. With the periscope 184 design, the recharging operation may be underwater so as not to be easily detected, especially at night.

The six JUV-9 torpedoes 100 are coupled in a launch frame 178 on the platform torpedo launcher 170. As in the Gatling torpedo launcher 132 and as shown in FIGS. 7 and 8, hook-locks 140 fasten the JUV-9 torpedo 100 to the launch frame 178 for securement. Power cables, such as +48 V DC cable 146, are coupled to each torpedo providing power to the plurality of torpedoes. The +48 V DC cable 146 power cable may be a copper cable. Copper/fiber optic cables 150 coupled to each JUV-9 torpedo 100 enable programming of the plurality of JUV-9 torpedoes 100. In this way, the JUV-9 torpedo 100, such as a smart mini torpedo (SMT), may be quickly programmed with a navigational plan prior to launch eliminating the need for manned operation. In one embodiment, the JUV-9 torpedoes 100 may be programmed with a desired travel plan and target signature from a control center via a communication link before launch. The communication link may be 4G/5G mobile telecommunications, satellite communications or fiber optic communication, and the control center may be land based or underwater based, such as from another submarine or vessel. In another embodiment, the JUV-9 torpedoes 100 may be programmed before being loaded in the platform torpedo launcher 170. The first connector 144 includes the first motor 142 and the electronic control unit 152 for controlling the operation of the fastening and unfastening of the hook-locks 140. The second connector 143 includes the second motor 147 and the electronic control unit 152 for controlling the operation of the fastening and unfastening of the cables. In a further embodiment, the JUV-9 torpedoes 100 may be programmed through a fiber optic cable from a traditional submarine to the platform torpedo launcher 170.

To launch the torpedoes, such as the JUV-9 torpedoes 100, using the catamaran torpedo storage and launch system 172 or the platform torpedo launcher 170, the locking means, the power cables and the fiber optic cables are disengaged from the torpedo. Each torpedo is then launched, by buoyancy. The plurality of torpedoes execute a navigation plan after the launch. The method for an aquatic vehicle torpedo launch system such as the catamaran torpedo storage and launch system 172, the platform torpedo launcher 170 or the Gatling torpedo launcher 132 is depicted in FIG. 12.

Figure 14:
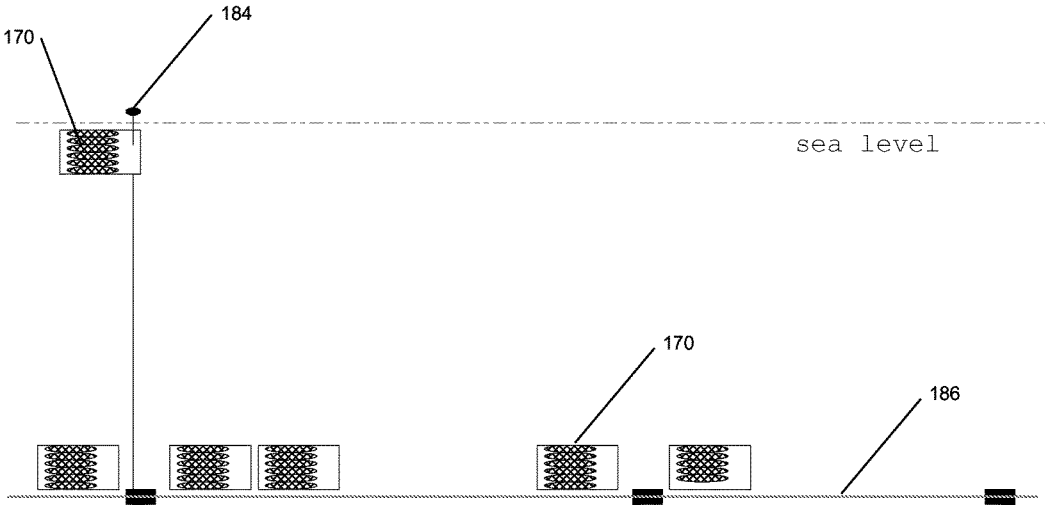
FIG. 14 shows an example embodiment of the platform torpedo launcher deployed on the sea floor.

FIG. 14 shows an example embodiment of the platform torpedo launcher 170 deployed on the sea floor. This may be connected to a fiber optic network 186 on the sea floor as disclosed in U.S. patent application Ser. No. 14/510,086, filed Oct. 8, 2014, and titled, "Aquatic Vessel Fiber Optic Network." In this way, the torpedoes such as the JUV-9 torpedoes 100 may be launched underwater via the control center on the fiber optic network 186. The platform torpedo launcher 170 may stay in operation for months to years by surfacing once every few days for recharging the battery pack 182. In this configuration, the platform torpedo launcher 170 with high density fire power is always deployed at sea and ready to launch.

Figure 15:
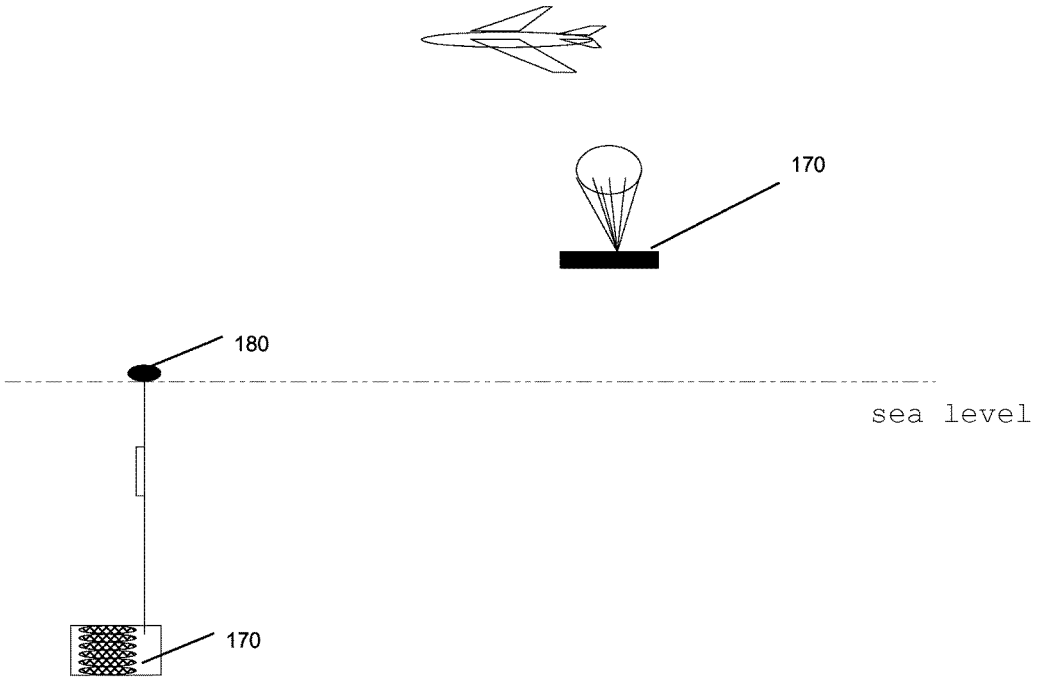
FIG. 15 depicts an example embodiment of the platform torpedo launcher being dropped from the air attached to a parachute.

The platform torpedo launcher 170 or the catamaran torpedo storage and launch system 172 may be dropped from the air for delivery towed by a vessel and transported in a freight container for fast deployment. FIG. 15 depicts an example embodiment of the platform torpedo launcher 170 being dropped from the air attached to a parachute. By using an air drop, the efficiency of deploying an unmanned vehicle may be significantly increased because the vehicle does not need to return to port for refilling of the torpedoes. A second platform torpedo launcher 170 is also depicted emerging for recharging the battery pack 182.

Figure 16:
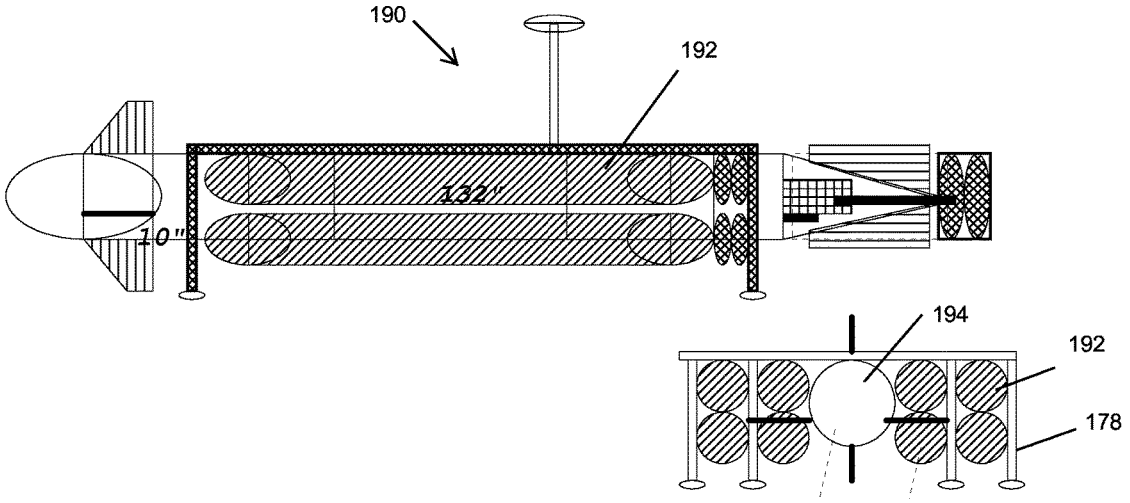
FIG. 16 is an example embodiment of a J-type underwater vehicle as an underwater naval defense system (JUV-UNDS).

FIG. 16 is an example embodiment of a J-type underwater vehicle as an underwater naval defense system (JUV-UNDS) 190. The JUV-UNDS 190 may be designed for littoral warfare. A plurality of high density torpedoes 192, such as eight torpedoes, are located on a single hull 194. The high density torpedoes 192 are coupled in a launch frame 178. As in the Gatling torpedo launcher 132 and as shown in FIGS. 7 and 8, hook-locks 140 fasten the high density torpedoes 192 to the launch frame 178 for securement. Power cables, such as +48 V DC cable 146, are coupled to each torpedo providing power to the plurality of torpedoes. The +48 V DC cable 146 power cable may be a copper cable. Copper/fiber optic cables 150 are coupled to each high density torpedo 192 to enable programming of the high density torpedoes 192. Similar to the other torpedo launchers disclosed herein, to launch a torpedo, the locking means, the power cables and the fiber optic cables are disengaged from the high density torpedo 192. Each high density torpedo 192 is then launched, by buoyancy. The plurality of torpedoes execute a navigation plan after the launch. The method for the configuration of this launch system is also depicted in FIG. 12.

In this example embodiment, the torpedoes may be launched from the open sea floor or underwater. With an existing sonobuoy system included in the launch systems, the flat 6-pack torpedo launch system may be low cost and a powerful air drop attacking submarine. The 6-torpedo launch system may be towed by a vessel and delivered to a deployment point on the sea floor for littoral warfare. In one embodiment, a JUV, such as a JUV-18, is equipped with a gas engine and a 6-torpedo launch system. With this configuration, the JUV-18 may be underwater for years.

The Gatling torpedo launcher 132 and the platform torpedo launcher 170 may be capable of being reloaded with the plurality of torpedoes in the open sea. For example, after all the torpedoes are launched from the torpedo launcher, the refill can take place on the open sea to save time and avoid vulnerability of being detected and possibly destroyed by returning to a base port.

When comparing the Gatling torpedo launcher 132 and the platform torpedo launcher 170 to traditional submarine based torpedo launchers, the Gatling torpedo launcher 132 and the platform torpedo launcher 170 are a low cost option. These systems also provide precision to the target when launching torpedoes because of the programming capabilities or the torpedoes. Typical torpedoes are not programmable. Moreover, the Gatling torpedo launcher 132 and the platform torpedo launcher 170 provide human safety because the torpedoes may be loaded and deployed with unmanned operation. Also, there is essentially no torpedo load time per torpedo because the systems have multi-barrel designs for the launching of the torpedoes thereby providing efficiency.

In another embodiment, the JUV-9 torpedoes 100 may be launched for drills or exercises multiple times, such as one hundred times, by a control center. For example, after final approach to the simulated target, the mission may be aborted and the JUV-9 torpedoes 100 may be retrieved, recharged and reinstalled into the torpedo launcher. As a result, the cost of the drills or exercises may be minimal and the skill and precision may improve over the course of the trials.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the invention. Thus, it is intended that the present subject matter covers such modifications and variations.

What is claimed is:

1. An aquatic vehicle torpedo launch system comprising:

(a) an aquatic vehicle;

(b) a torpedo launch system coupled to the aquatic vehicle, the torpedo launch system operable in a neutral buoyance position;

(c) a plurality of torpedoes, each torpedo coupled to the torpedo launch system in a first position with a locking means;

(d) power cables coupled to each torpedo providing power to the plurality of torpedoes; and (e) fiber optic cables coupled to each torpedo enabling programming of the plurality of torpedoes;

wherein the locking means, the power cables and the fiber optic cables are disengaged from the plurality of torpedoes prior to launch; and wherein each torpedo is launched by buoyancy, initially floating out of plane with respect to the first position of each torpedo when disengaged from the torpedo launch system.

2. The system of claim 1, the torpedo launch system comprising:

a stationary support frame;

a barrel assembly including a circular array of substantially parallel barrels with an axial shaft, the circular array of barrels mounted to rotate within the stationary support frame on the axial shaft; and a rotation means for rotating the barrel assembly such that each barrel is rotated past a stationary firing position once during each revolution of the barrel assembly, the stationary firing position being located in the support frame adjacent the barrel assembly;

wherein a door on the aquatic vehicle being located above the stationary firing position and having a closed first position and an open second position; and wherein when the door is in the open second position, the locking means, the power cables and the fiber optic cables are disengaged from the plurality of torpedoes.

3. The system of claim 2, wherein the aquatic vehicle is capable of storing up to 40 torpedoes at one time.

4. The system of claim 1, wherein the torpedo launch system comprises:

a platform being flat; and a stationary support frame coupled to the platform.

5. The system of claim 4, wherein the torpedo launch system with the plurality of torpedoes is capable of being:

dropped from air for delivery;

towed by a vessel; and transported in a freight container.

6. The system of claim 1, wherein the aquatic vehicle is configured to operate unmanned.

7. The system of claim 1, wherein the plurality of torpedoes are capable of being programmed with a navigational plan prior to launch.

8. The system of claim 1, wherein more than one torpedo of the plurality of torpedoes is launched at the same time.

9. The system of claim 1, wherein the plurality of torpedoes execute a navigation plan after the launch.

10. The system of claim 1, wherein the torpedo launch system is capable of being reloaded with the plurality of torpedoes in open sea.

11. A method for configuring an aquatic vehicle torpedo launch system comprising:

providing an aquatic vehicle;

coupling a torpedo launch system to the aquatic vehicle, the torpedo launch system operable in a neutral buoyance position;

coupling a plurality of torpedoes to the torpedo launch system in a first position with a locking means;

coupling power cables to each torpedo, the power cables providing power to the plurality of torpedoes;

coupling fiber optic cables to each torpedo, the fiber optic cables enabling programming of the plurality of torpedoes; and configuring the locking means, the power cables and the fiber optic cables to be disengageable from the torpedo;

wherein each torpedo is launched by buoyancy, initially floating out of plane with respect to the first position of each torpedo when disengaged from the torpedo launch system.

12. The method of claim 11, wherein the torpedo launch system comprises:

a stationary support frame;

a barrel assembly including a circular array of substantially parallel barrels with an axial shaft, the circular array of barrels mounted to rotate within the stationary support frame on the axial shaft; and a rotation means for rotating the barrel assembly such that each barrel is rotated past a stationary firing position once during each revolution of the barrel assembly, the stationary firing position being located in the support frame adjacent the barrel assembly.

13. The method of claim 11, wherein the method further includes:

locating a door on the aquatic vehicle above a stationary firing position, the door having a closed first position and an open second position; and configuring the door to be unfastened to the open second position;

wherein when the door is in the open second position, the locking means, the power cables and the fiber optic cables are disengaged from the plurality of torpedoes.

14. The method of claim 11, wherein the aquatic vehicle is capable of storing up to 40 torpedoes at one time.

15. The method of claim 11, wherein the torpedo launch system comprises:

a platform being flat; and a stationary support frame coupled to the platform.

16. The method of claim 15, wherein the torpedo launch system with the plurality of torpedoes is capable of being:

dropped from the air for delivery;

towed by a vessel; and transported in a freight container.

17. The method of claim 11, wherein the aquatic vehicle is configured to operate unmanned.

18. The method of claim 11, wherein the plurality of torpedoes are capable of being programmed with a navigational plan prior to launch.

19. The method of claim 11, wherein the plurality of torpedoes execute a navigation plan after the launch.

20. The method of claim 11, wherein the torpedo launch system is capable of being reloaded with the plurality of torpedoes in open sea.

* * * * *